US008078089B2

(12) United States Patent
Kunihiro et al.

(10) Patent No.: US 8,078,089 B2
(45) Date of Patent: Dec. 13, 2011

(54) DEVELOPMENT APPARATUS WITH A DEVELOPMENT ROLLER SCRAPER AND IMAGE FORMING APPARATUS INCLUDING THE SAME

(75) Inventors: Hisashi Kunihiro, Nara (JP); Koichi Mihara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 403 days.

(21) Appl. No.: 12/396,610

(22) Filed: Mar. 3, 2009

(65) Prior Publication Data

US 2009/0226220 A1 Sep. 10, 2009

(30) Foreign Application Priority Data

Mar. 4, 2008 (JP) ..... 2008-053483

(51) Int. Cl.
*G03G 15/08* (2006.01)

(52) U.S. Cl. ..... 399/273

(58) Field of Classification Search ..... 399/273, 399/283

See application file for complete search history.

(56) References Cited

U.S. PATENT DOCUMENTS

| | | | | |
|---|---|---|---|---|
| 4,601,258 | A * | 7/1986 | Kondoh | 399/272 |
| 5,570,164 | A * | 10/1996 | Yamamoto et al. | 399/283 |
| 5,623,718 | A * | 4/1997 | Bracken et al. | 399/284 |
| 5,797,076 | A * | 8/1998 | Bracken et al. | 399/284 |

FOREIGN PATENT DOCUMENTS

| | | | |
|---|---|---|---|
| JP | 55-118061 | A | 9/1980 |
| JP | 61-126267 | | 8/1986 |
| JP | 10-293456 | A | 11/1998 |
| JP | 2000-321870 | | 11/2000 |
| JP | 2001117358 | A * | 4/2001 |
| JP | 2002-148921 | A | 5/2002 |
| JP | 2002-268374 | A | 9/2002 |
| JP | 2002-372855 | | 12/2002 |

* cited by examiner

*Primary Examiner* — Quana M Grainger
(74) *Attorney, Agent, or Firm* — Nixon & Vanderhye P.C.

(57) ABSTRACT

One embodiment of a development apparatus includes a developer carrier that transports a two-component developer and a scraper that detaches the two-component developer transported by the developer carrier from a surface of the developer carrier. Also, a front end of the scraper is formed so as not to have an edge that is less than 90 degrees. Further, the development apparatus includes a scraper pedestal having rigidity, and the scraper is fixed on the scraper pedestal.

11 Claims, 5 Drawing Sheets

DEVELOPMENT APPARATUS WITH A DEVELOPMENT ROLLER SCRAPER AND IMAGE FORMING APPARATUS INCLUDING THE SAME

BACKGROUND OF THE TECHNOLOGY

This application claims priority under 35 U.S.C. §119(a) on Patent Application No. 2008-53483 filed in Japan on Mar. 4, 2008, the entire contents of which are herein incorporated by reference.

The present technology relates to a development apparatus that uses a two-component developer containing toner and a carrier, and an image forming apparatus using the same.

In general, processes such as charging, exposure, developing, transfer, cleaning, charge removal, and fixing are performed in an image forming apparatus using an electrostatic photographic image forming method. In a process of forming an image in such an image forming apparatus, for example, the surface of an image carrier such as a photosensitive drum that is driven to rotate is uniformly charged by a charging apparatus, and a laser beam is irradiated onto the surface of the charged image carrier by an exposing apparatus. Then, an electrostatic latent image is formed on the surface of the image carrier. Subsequently, a developer carrier such as a development roller, for example, of the development apparatus transports developer to a development nip portion between the developer carrier and the image carrier. The electrostatic latent image formed on the image carrier is developed by the developer transported to the development nip portion, and a toner image is formed on the surface of the image carrier. The toner image formed on the image carrier is transferred on a transfer material (recording medium) by a transfer apparatus. Then, the toner image is heated by a fixing apparatus and fixed on the transfer material. Further, residual transferring toner remaining on the surface of the image carrier is removed by a cleaning apparatus, and collected in a prescribed collecting section. Residual charge on the surface of the image carrier that has been cleaned is also removed by a charge removal apparatus. Thus, the image forming apparatus is prepared for next image forming.

In general, a one-component developer that is mainly composed of toner and a two-component developer that is mainly composed of toner and a carrier are used as developer that develops an electrostatic latent image on an image carrier. Since a carrier is not used in the one-component developer, a stirring mechanism for uniformly mixing toner and a carrier and the like are not necessary. Thus, there is an advantage in that the development apparatus can be made simple; however, there is a disadvantage in that a stable charging level in the toner is difficult to obtain, and the like. Accordingly, in general, the two-component developer is often used in a high-speed image forming apparatus and a color image forming apparatus.

On the other hand, as for the two-component developer, when a toner content rate in the developer (hereinafter, referred to as toner concentration) changes on the developer carrier, image density also changes in a portion in which the toner concentration has been changed. Thus, it is necessary for a development apparatus that uses the two-component developer to develop an image carrier using developer that always has a constant toner concentration. Therefore, in order to make the toner concentration constant in the development apparatus, the developer carrier supplies toner onto the surface of the image carrier after sufficiently stirring the two-component developer (carrier and toner).

However, toner is consumed as it is provided for developing and, thus, the two-component developer includes a portion in which the toner concentration has been changed. Then, if the developer is again provided for developing from the developer carrier to the surface of the image carrier, but without being separated from the surface of the developer carrier, image failure in that image density is uneven on a portion in which the toner concentration has been changed, what is known as a development memory problem, occurs.

To address this problem, for example, JP2000-321870A (Patent Document 1) discloses a development apparatus that is provided with a scraper for scraping a two-component developer from the surface of a developer carrier, so that the developer on the developer carrier that is once provided for development on the surface of an image carrier and whose toner is consumed is not provided again, by preventing it from making one revolution together with the rotation of the developer carrier.

However, if the development apparatus is provided with the scraper as disclosed in the aforementioned Patent Document 1, problems will arise. For example, a toner aggregate is likely to occur at a front end portion of the scraper, and image irregularity is likely to occur caused by filming of a toner component on the surface of the developer carrier.

SUMMARY OF THE TECHNOLOGY

The technology was made in view of the above problems, and it is an object to provide a development apparatus and an image forming apparatus that can effectively prevent a toner aggregate that may occur at the front end portion of the scraper and, thus, can suppress image failure such as image irregularity from occurring for a long time.

According to the view of the inventors of the technology, in a development apparatus that includes a developer carrier such as a development roller, for example, that transports a two-component developer; and a scraper that detaches the two-component developer transported by the developer carrier from the surface of the developer carrier, the result of studying the generation mechanism of a toner aggregate that may occur at a front end portion of the scraper is as follows. The study revealed that, by repeatedly developing, an extraneous substance such as a microscopic fiber of paper or malt mixed in the two-component developer becomes stuck to the front end of the scraper and becomes a core, which proceeds to aggregate toner.

Furthermore, it was found that, by forming the front end of the scraper so as not to include a sharp edge, a microscopic extraneous substance such as paper can be effectively prevented from being stuck and trapped at the front end of the scraper, and consequently, a toner aggregate caused by this can be effectively prevented, suppressing image failure such as image irregularity from occurring for a long time.

In order to address the aforementioned problems, the technology is based on such findings, and a development apparatus includes a developer carrier that transports a two-component developer and a scraper that detaches the two-component developer transported by the developer carrier from a surface of the developer carrier. Also, a front end of the scraper is formed so as not to have an edge that is less than 90 degrees.

According to such a development apparatus, the front end of the scraper is formed so as not to include an edge whose angle is 90 degrees or less. Thus, a toner aggregate that may occur at the front end of the scraper can be effectively prevented, and this can suppress image failure such as image irregularity from occurring for a long time.

In the development apparatus, it is preferable that the front end of the scraper is formed so as to be composed of an obtuse angle or a curvature of 0.4 to 2 mm, inclusive.

Accordingly, since the front end of the scraper is composed of an obtuse angle or a curvature of 0.4 to 2 mm, inclusive, an extraneous substance such as a fiber can hardly be trapped at the front end of the scraper.

In the development apparatus, it is preferable that a top face of the front end of the scraper is formed so as to have a curvature that increases with distance from the developer carrier.

Accordingly, since the top face of the front end of the scraper has a curvature that increases with distance from the developer carrier, even if the scraper is made thicker, developer can flow well, because the curvature gradually changes with distance from the developer carrier.

In the development apparatus, it is preferable that the scraper is disposed with a gap of 0.8 to 1.5 mm, inclusive, with respect to the surface of the developer carrier.

Accordingly, since the scraper is disposed with a gap of 0.8 to 1.5 mm, inclusive, with respect to the surface of the developer carrier, an extraneous substance such as a microscopic fibers can hardly be caught between the scraper and the developer carrier while the effect of scraping the developer is maintained. Thus, toner can be further prevented from aggregating, and the generation of a development memory can be accordingly reduced, and image failure such as image irregularity can be suppressed from occurring for a long time.

In the development apparatus, it is preferable that the scraper is disposed so as to be inclined by 30 to 60 degrees, inclusive, with respect to a horizontal direction.

Accordingly, since the scraper is disposed so as to be inclined by 30 to 60 degrees, inclusive, with respect to a horizontal direction, stress can be reduced when scraping developer on the surface of the developer carrier, and the developer scraped from the developer carrier can be smoothly transported just by its own weight, in a direction separating from the developer carrier.

In the development apparatus, it is preferable that a scraper pedestal having rigidity is provided, and the scraper is fixed on the scraper pedestal.

Accordingly, since the scraper is fixed on the scraper pedestal, the scraper can be prevented from vibrating due to the flow of developer. Thus, this enables the developer to be stably transported.

In this case, it is preferable that the scraper is integrally formed (e.g. integrally molded) with the scraper pedestal.

Accordingly, since the scraper is integrally formed with the scraper pedestal, the front end of the scraper can be prevented from being deformed due to the flow of developer. Thus, the effect of scraping the developer can be stably obtained.

In the development apparatus, it is preferable that the scraper is made of a resin that includes a electrically conductive carbon black.

Accordingly, since the scraper is made of a resin that includes the electrically conductive carbon black, triboelectric charging between the scraper and toner can be prevented. Thus, this can suppress toner from adhering to the surface of the scraper.

In the development apparatus, it is preferable that the scraper is made of a resin that includes a silica microparticle or a glass fiber.

Accordingly, since the scraper is made of a resin that includes a silica microparticle or a glass fiber, a hard silicon compound can be exposed on the surface of the scraper. Thus, this can suppress abrasion caused by friction with the developer and can also prevent toner fusion. Consequently, the surface of the scraper can be kept smooth accordingly for a longer time.

Furthermore, the technology also provides an image forming apparatus that includes the development apparatus.

Accordingly, a toner aggregate that may occur in the development apparatus can be effectively prevented, and this can suppress image failure such as image irregularity from occurring for a long time.

BRIEF DESCRIPTION OF THE DRAWINGS

FIG. 2(*a*) is a cross-sectional view of a developer carrier and the scraper that are extracted from the development apparatus shown in FIG. 1. FIG. 2(*b*) is an enlarged side view of a front end portion of the scraper.

FIG. 3(*a*) is a cross-sectional view of the scraper, and FIG. 3(*b*) is an enlarged side view of a front end portion of the scraper.

FIG. 4(*a*) is a cross-sectional view of the scraper, and FIG. 4(*b*) is an enlarged side view of a front end portion of the scraper.

DESCRIPTION OF THE PREFERRED EMBODIMENTS

In the following, embodiments are described with reference to the drawings. Note that, the embodiments described below are exemplary embodiments which do not limit the technical scope of the technology.

Overall Configuration of Development Apparatus

Figure 1:
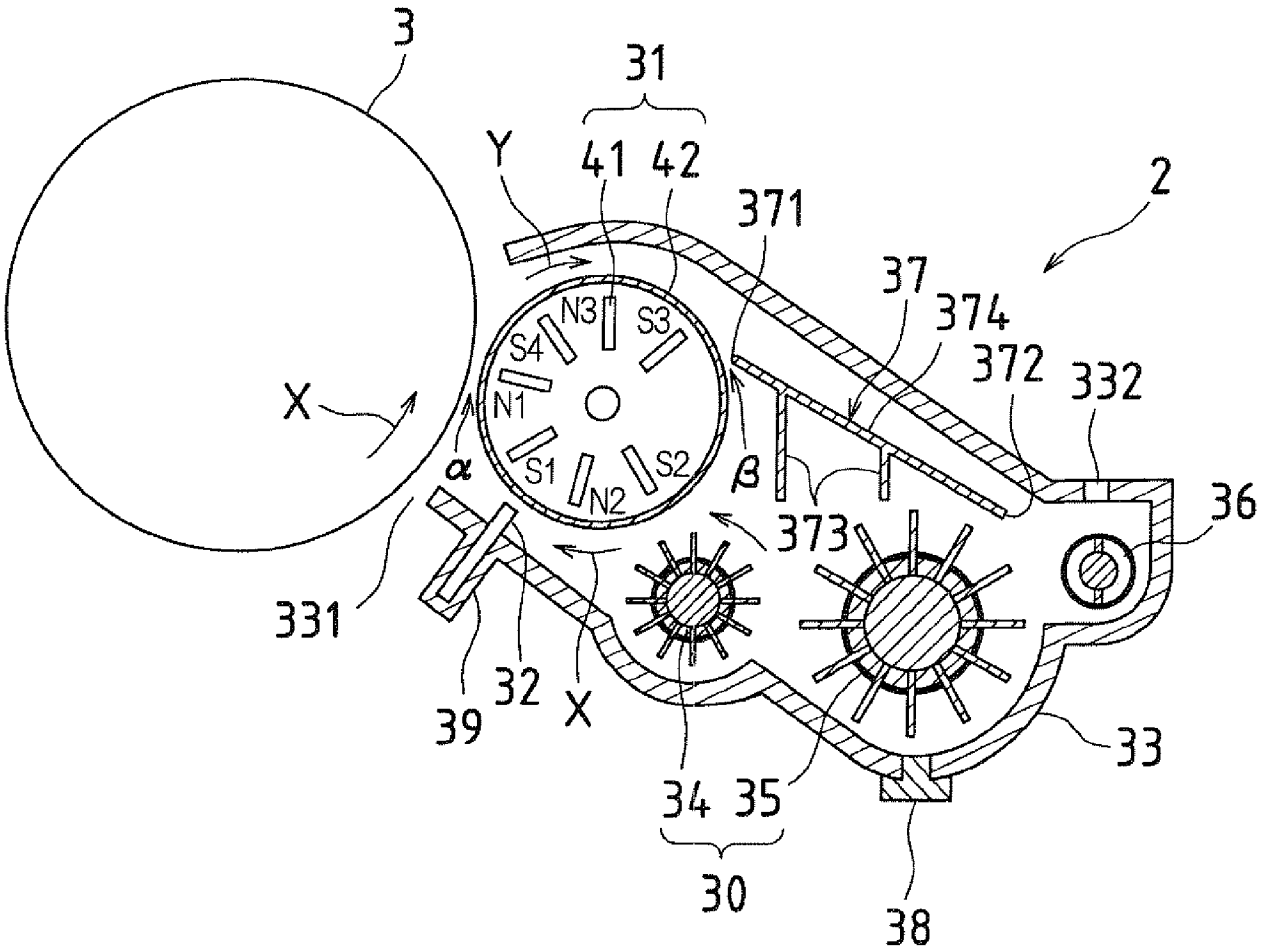
FIG. 1 is a cross-sectional view of a development apparatus.
Figure 2B:
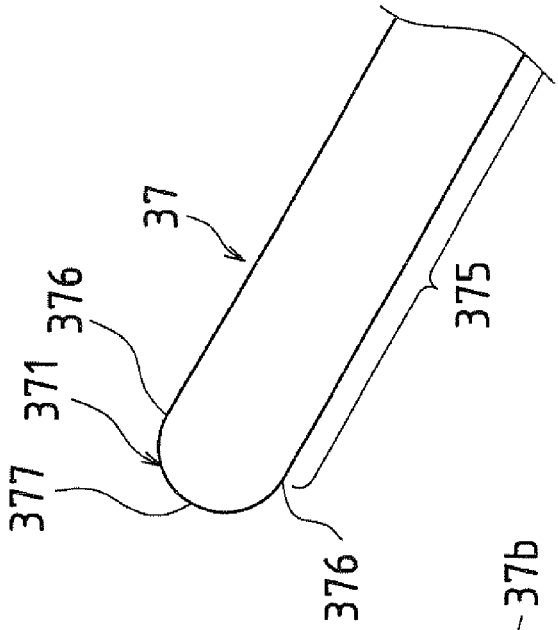
FIGS. 2(*a*) and 2(*b*) illustrate a scraper of a development apparatus shown in FIG. 1.
Figure 2A:
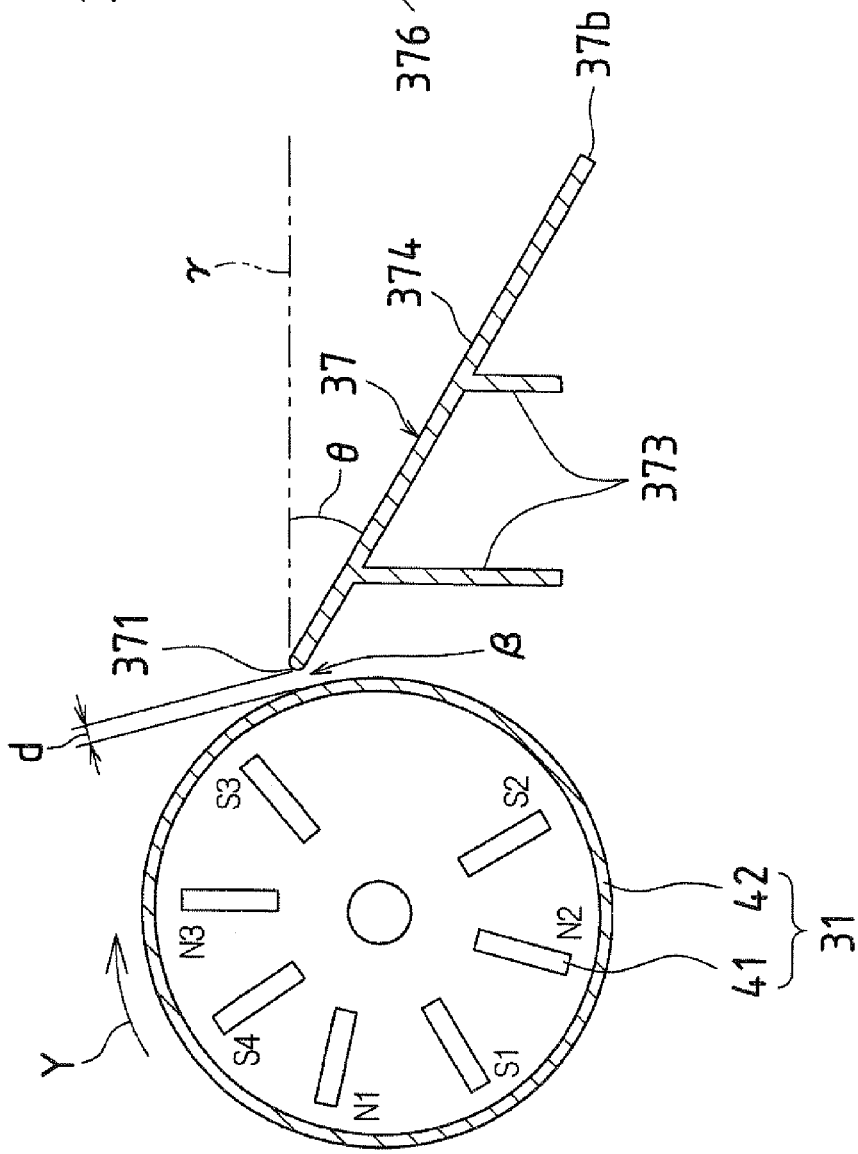

FIG. 1 is a cross-sectional view of a development apparatus 2. FIGS. 2(*a*) and 2(*b*) illustrate a scraper of the development apparatus 2 shown in FIG. 1. FIG. 2(*a*) is a cross-sectional view of a developer carrier and the scraper extracted from the development apparatus 2 shown in FIG. 1. FIG. 2(*b*) is an enlarged side view of a front end (371) portion of the scraper.

The development apparatus 2 includes a development roller 31 as a developer carrier as shown in FIG. 1. And, the development apparatus 2 supplies toner onto the surface of a photosensitive drum 3 that is used as an image carrier in an image forming apparatus 100 and makes an electrostatic latent image formed on the surface of the photosensitive drum 3 develop.

The development apparatus 2 includes a control member 32, a transport member 36, a stirring member 30 and the scraper 37 in addition to the development roller 31, and also includes a development tank 33 that contains these. In the present embodiment, developer is a two-component developer including toner and a carrier that is a magnetic powder.

The development roller 31 carries developer on its surface and supplies toner onto an electrostatic latent image on the photosensitive drum 3 while rotating around its axis, and develops the image. The control member 32 controls an amount of developer carried on the surface of the development roller 31. The development tank 33 supports the development roller 31 and the stirring member 30 in such a manner that they can rotate, and stores developer in its interior space. In the development tank 33, an opening 331 is provided at a position opposing the photosensitive drum 3, and a toner supply opening 332 for supplying toner is provided so as to oppose the photosensitive drum 3 with the opening 331 therebetween.

The transport member 36 transports toner supplied from the toner supply opening 332 provided to the development tank 33, to the stirring member 30. The stirring member 30 is composed of a first stirring member 34 and a second stirring member 35 here. The first stirring member 34 and the second stirring member 35, which are disposed between the development roller 31 and the transport member 36, stir the developer in the development tank 33 uniformly, and transport it to the development roller 31. The second stirring member 35 is disposed between the transport member 36 and the first stirring member 34. As described below, the second stirring member 35 stirs developer dropping from a rear end 372 of the scraper 37 and toner from the transport member 36, and transports it to the first stirring member 34. The first stirring member 34 is disposed between the second stirring member 35 and the development roller 31, and transports the developer from the second stirring member 35 to the development roller 31.

Specifically, the development roller 31 is supported by the development tank 33 so as to be rotatable around its axis. A drive unit (not shown) drives the development roller 31 to rotate around its axis in the prescribed rotating direction (direction indicated by an arrow Y in FIG. 1). In addition, the development roller 31 is arranged so as to oppose the photosensitive drum 3 with the opening 331 provided to the development tank 33 therebetween. The development roller 31 is provided so as to be separated from the photosensitive drum 3 with a gap therebetween. An area containing a portion in which the photosensitive drum 3 and development roller 31 are most adjacent is a development nip portion α. In the development nip portion α, toner can be supplied from a developer layer (not shown) formed on the surface of the development roller 31 to an electrostatic latent image on the surface of the photosensitive drum 3. At this time, by applying a developing bias voltage to the development roller 31 from a power supply for applying a developing bias voltage (not shown) connected to the development roller 31, transfer of toner from the developer layer in the development nip portion α on the surface of the development roller 31 to the electrostatic latent image on the surface of the photosensitive drum 3 is smoothly performed.

The development roller 31 includes magnetic rollers 41 and a sleeve 42. The magnetic rollers 41, with both end portions in the long side direction thereof being supported by the development tank walls of the development tank 33, are multipolar-magnetization-type magnetic rollers composed of a plurality of plate-like magnets that are arranged inside the sleeve 42. The plurality of magnets in the sleeve 42 are respectively magnetized (magnetic polarization) in the short side direction and disposed so that the long side direction is parallel to the axial direction of the development roller 31. Further, the plurality of magnets are radially disposed along the radial direction of the development roller 31 so that they are separated from each other at positions in the circumferential direction of the development roller 31, and that magnetic poles N1, N2, N3, S1, S2, S3, and S4 in the short side direction thereof face the exterior. The magnetic poles that face the exterior are disposed so that the magnetic poles N1, S1, N2, S2, S3, N3 and S4 are arranged in the stated order in a direction opposite to the rotating direction Y of the development roller 31 (sleeve 42).

The sleeve 42 is a cylindrical member, and the magnetic roller 41 is fitted therein. The sleeve 42 is supported by the development tank 33 and a supporting member (not shown) so as to be rotatable around its axis, and driven to rotate by a drive unit (not shown). The sleeve 42 can be formed using a nonmagnetic material. In this embodiment, the sleeve 42 rotates in the clockwise direction Y as shown in FIG. 1, and the photosensitive drum 3 rotates in a counterclockwise direction X as shown in FIG. 1, which is opposite to the rotating direction Y of the sleeve 42.

The control member 32 is a plate-like member that extends parallel to the axial direction of the development roller 31. The control member 32 removes excessive developer from the developer layer carried on the surface of the development roller 31 and adjusts an amount of developer to be transported by controlling the thickness of the developer layer so as to be constant. Moreover, the control member 32 gives a charge to developer that is not sufficiently charged among the developer contained in a developer layer, by another end portion thereof in the short side direction being rubbed with the developer layer, and sufficiently charges the developer contained in the developer layer.

In this embodiment, the control member 32 being disposed below the development roller 31 in the vertical direction, one end portion in its short side direction is supported by the development tank 33 and a cover member 39 that covers the control member 32, and another end portion is disposed so as to be separated from the surface of the development roller 31 with a gap therebetween. The control member 32 is formed of a material such as a nonmagnetic metal that has elastic properties such as stainless steel and aluminum, or synthetic resin, for example. In the present embodiment, the control member 32 is made of stainless steel formed into a sheet.

The development apparatus 2 shown in FIG. 1 further includes a toner concentration detection sensor 38 that detects toner concentration in the two-component developer contained inside the development tank 33. The toner concentration detection sensor 38 can detect the toner concentration of developer stirred by the stirring member 30 herein.

Description of Features of the Technology

As shown in FIGS. 1, 2(*a*) and 2(*b*), the scraper 37 scrapes developer or a developer layer on the surface of the development roller 31 that moves along the development roller 31 rotating around the axis.

The scraper 37 is a plate-like member that extends parallel to the axial direction of the development roller 31. In the development tank 33, the scraper 37 is disposed on a downstream side of the development nip portion α along the rotating direction Y of the development roller 31 and on an upstream side of the stirring member 30 (here, above the stirring member 30 in the vertical direction). Specifically, along the rotating direction Y of the development roller 31, the scraper 37 is disposed on a downstream side of a connect point between the development roller 31 and a virtual straight line parallel to the scraper 37, and on a upstream side of the stirring member 30 (here, the first stirring member 34 on a side closer to the development roller 31).

The front end 371 of the scraper 37 is opposing the development roller 31 and formed so as to have a circular arc that is projecting to the development roller 31 side when viewed from a side (viewed from the axial direction of the development roller 31). In addition, the front end 371 of the scraper 37 is formed so as to have a curvature of 0.4 mm to 2 mm, inclusive. Here, "the front end of the scraper" refers to an area from a lateral front end portion 376 of a lateral face 375 to a tip portion 377 of the scraper 37, and an area including the tip portion 377 (see FIG. 2(*b*)).

One end (front end) 371 of the scraper 37 is separated from and opposes the surface of the development roller 31 with a gap d therebetween. Further, the other end (rear end) 372 side of the scraper 37 extends in a direction away from the development roller 31, and the scraper 37 is disposed so that a top face 374 gradually declines downward in the vertical direction (from the front end 371 toward the rear end 372) as the distance from the development roller 31 increases. Here, both end portions of the scraper 37 in its long side direction are supported by the development tank walls of the development tank 33.

In the development apparatus 2 described above, the front end 371 of the scraper 37 scrapes the two-component developer on the development roller 31 that has performed development of an electrostatic latent image carried onto the surface of the photosensitive drum 3, from the development roller 31. The scraped two-component developer flows along the top face 374 of the scraper 37 and drops from the end portion (rear end) 372 that is on a side opposite to the development roller 31 side in the short side direction of the scraper 37, to the stirring member 30 (here, second stirring member 35). The dropped developer is uniformly mixed with other developer and toner newly supplied from the transport member 36, by the first stirring member 34 and the second stirring member 35 and again transported to the development roller 31.

If the curvature of the front end 371 of the scraper 37 is less than 0.4 mm here, an extraneous substance such as a microscopic fiber of paper or a malt hair mixed in the two-component developer easily becomes stuck, and a toner aggregate may occur in a front end portion β of the scraper 37 with the extraneous substance being a core. On the other hand, if the curvature of the front end 371 of the scraper 37 is more than 2 mm, the effect of scraping developer cannot be sufficiently obtained.

In view of this, in the development apparatus 2 according to the present embodiment, since the curvature of the front end 371 of the scraper 37 is determined as 0.4 mm to 2 mm, inclusive, a toner aggregate that may occur in the front end portion β of the scraper 37 can be effectively prevented, and accordingly, image failure such as image irregularity can be suppressed from occurring for a long time.

In the present embodiment, the scraper 37 is disposed with a gap d of 0.8 mm to 1.5 mm, inclusive, with respect to the surface of the development roller 31. If the gap d is less than 0.8 mm, an extraneous substance such as talcum from paper mixed in the two-component developer easily becomes caught in the gap. If the gap d is more than 1.5 mm, the effect of scraping the two-component developer can be easily reduced.

Also, in the present embodiment, the scraper 37 is preferably disposed so as to be inclined by an angle θ of 30 to 60 degrees, inclusive, with respect to a virtual straight line along the horizontal direction (see a chain line γ in FIG. 2(*a*)). This enables the scraped developer to be smoothly transported just by its own weight along the top face 374 of the scraper 37 in a direction separating from the development roller 31 to the rear end 372 of the scraper 37, and the scraped developer can be favorably dropped downward from the rear end 372 in the vertical direction.

The scraper 37 is preferably fixed on a scraper pedestal 373 having rigidity. This can prevent the scraper 37 from vibrating (being deformed) due to the flow of developer (force of gravity on the developer) and, thus, the developer can be stably transported. Specifically, a plurality of scraper pedestals 373 (here, two) are disposed in the short side direction of the scraper 37. Concretely, the scraper pedestal 373 is a ribbed shaped member that extends in the long side direction of the scraper 37 and also extends downward in the vertical direction.

Furthermore, the scraper 37 is preferably integrally molded with the scraper pedestal 373 having rigidity. This can prevent the front end 371 of the scraper 37 from being deformed due to the flow of developer, and the effect of scraping developer can be stably obtained.

Although the scraper 37 can be made of a resin material such as polycarbonate and used, by adding a electrically conductive carbon black in resin, triboelectric charging between the scraper and toner can be prevented, so that toner can be suppressed from adhering onto the surface of the scraper.

A silica microparticle or a glass fiber can be added into the scraper 37. By doing so, a hard silicon compound can be exposed on the surface of the scraper 37. This can suppress a problem from occurring, such as toner components becoming a film or an external additive being buried. Furthermore, this can suppress abrasion caused by friction with the developer, and can also prevent toner fusion. Consequently, the surface of the scraper can be kept smooth for a long time.

Note that, in the present embodiment, although the shape of the front end of the scraper is composed of a curvature, the present technology is not limited to this. Any shape may be used as long as that does not include an angle of 90 degrees or less. For example, a shape composed of an obtuse angle may be used.

Figure 3A:
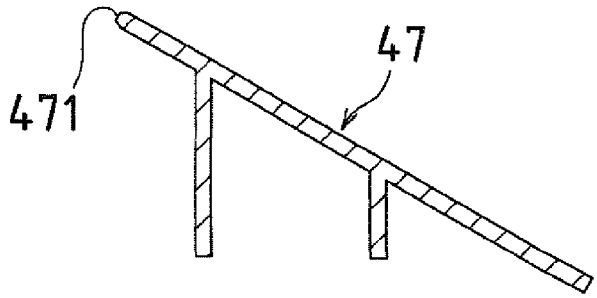
FIGS. 3(*a*) and 3(*b*) illustrate a scraper of a development apparatus.
Figure 3B:
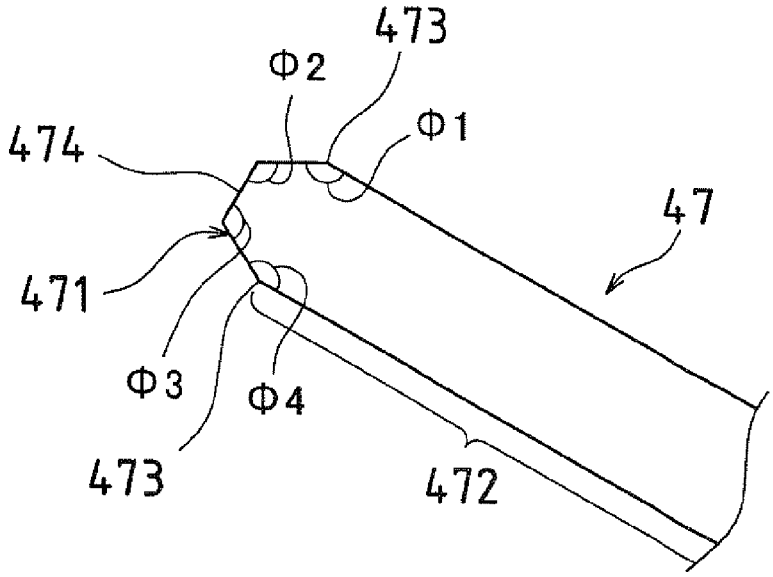

FIGS. 3(*a*) and 3(*b*) illustrate a second embodiment of a scraper 47 of a development apparatus. FIG. 3(*a*) is a cross-sectional view of the scraper 47, and FIG. 3(*b*) is an enlarged side view of a front end 471 portion of the scraper 47. As shown in FIG. 3(*b*), the front end 471 of the scraper 47 is composed of a plurality of obtuse angles (here, four obtuse angles ϕ1, ϕ2, ϕ3, and ϕ4 of approximately 135 degrees each). This makes an extraneous substance such as a fiber less likely to become stuck to an edge of the front end of the scraper. Note that, in FIG. 3(*b*), reference numeral 472 denotes a lateral face of the scraper 47; reference numeral 473 denotes a lateral front end portion of the lateral face 472 of the scraper 47; reference numeral 474 denotes a tip portion of the scraper 47.

Also, the front end of the scraper may have a shape whose curvature gradually increases along the front end with distance from the development roller 31.

Figure 4A:
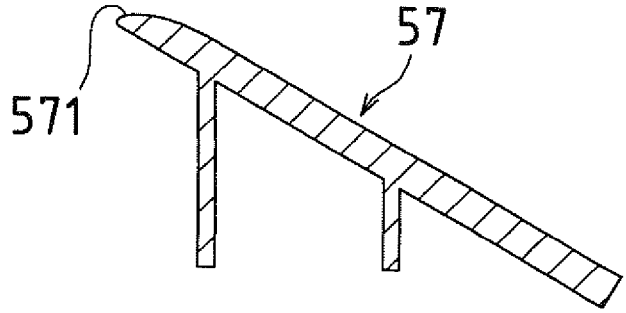
FIGS. 4(*a*) and 4(*b*) illustrate a scraper of a development apparatus.
Figure 4B:
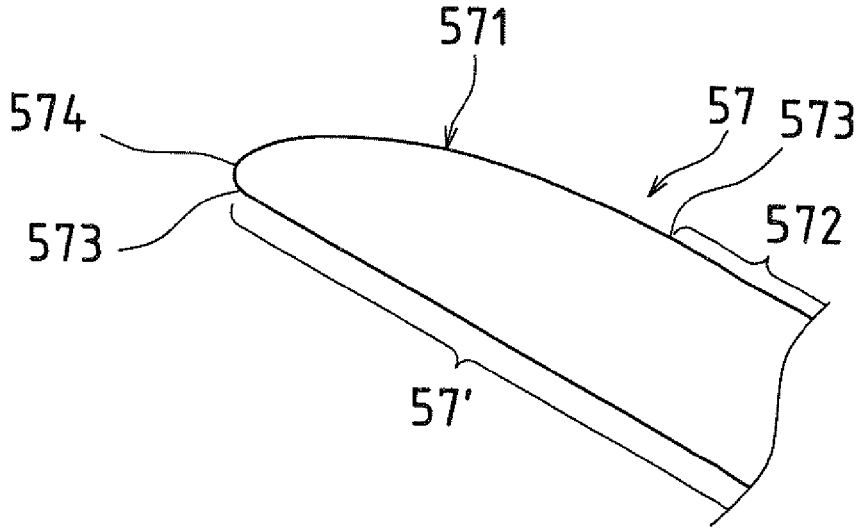

FIG. 4 illustrates a third embodiment of a scraper 57 of a development apparatus. FIG. 4(*a*) is a cross-sectional view of the scraper 57, and FIG. 4(*b*) is an enlarged side view of a front end 571 portion of the scraper 57. As shown in FIGS. 4(*a*) and 4(*b*), a curvature of a top face of the front end 571 of the scraper 57 gradually increases with distance from the development roller 31. With such a configuration, since the curvature of the top face of the front end 571 of the scraper 57 increases with distance from the development roller 31, even if the scraper 57 is made thicker, developer is less likely to be hindered at the front end portion of the scraper 57 and quickly flows in the direction away from the development roller 31. Note that, in FIG. 4(*b*), reference numeral 572 denotes a lateral face of the scraper 57; reference numeral 573 denotes a lateral front end portion of the lateral face 572 of the scraper 57; reference numeral 574 denotes a tip portion of the scraper 57.

Overall Configuration of Image Forming Apparatus

Figure 5:
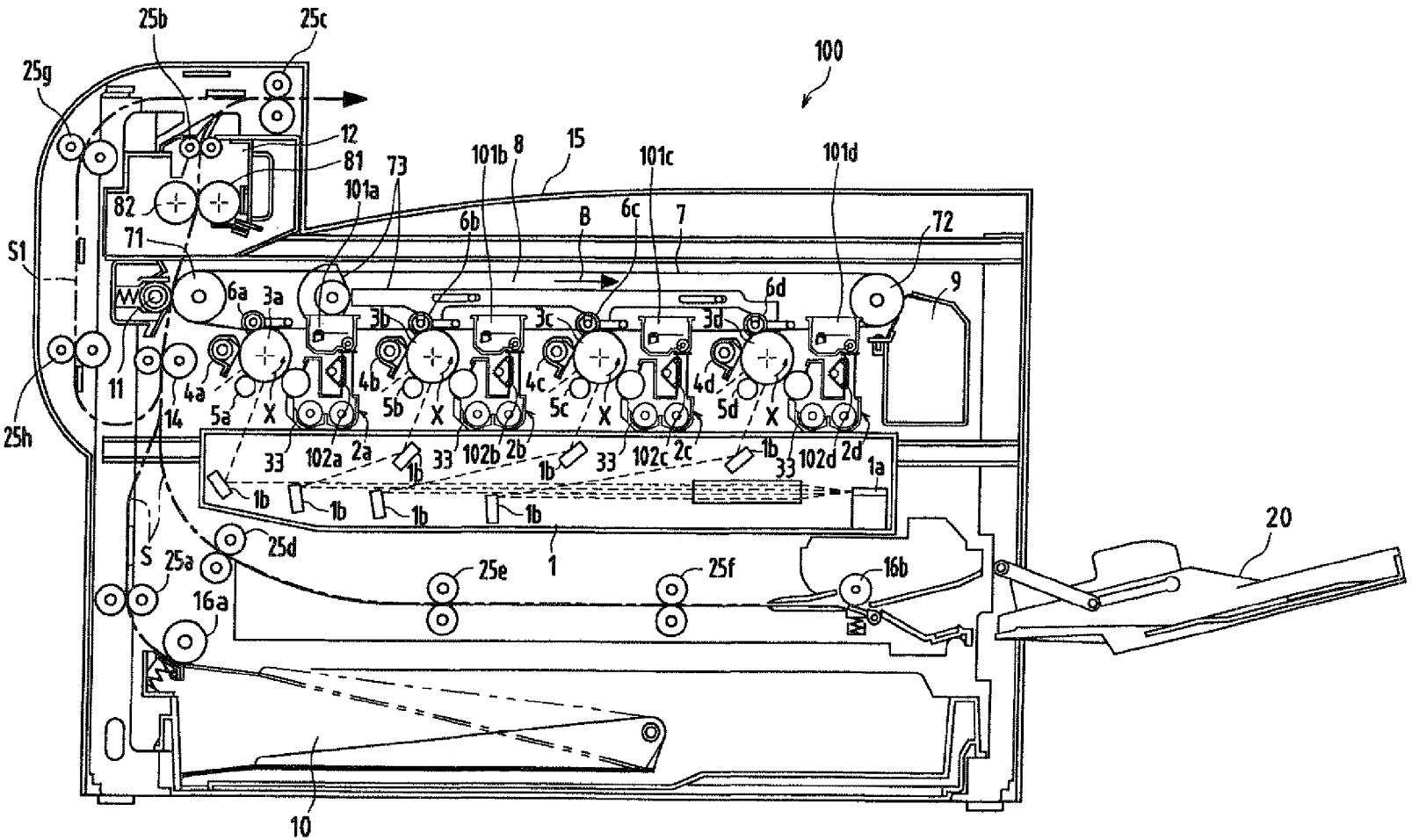
FIG. 5 illustrates a schematic configuration of one example of an image forming apparatus that includes a development apparatus shown in FIG. 1.

FIG. 5 is an illustration showing a schematic configuration of an example of an image forming apparatus that includes the development apparatus 2 shown in FIG. 1. In the present embodiment, the image forming apparatus 100 shown in FIG.

1 forms a multicolored or unicolored image on a prescribed sheet (recording medium) such as a recording paper, based on image data transmitted from the exterior through an electrophotographic image forming method. Note that the image forming apparatus 100 may include a scanner and the like on its upper part.

The image forming apparatus 100 includes photosensitive drums 3*a*, 3*b*, 3*c*, and 3*d* as an image carrier; charging apparatuses 5*a*, 5*b*, 5*c*, and 5*d*; an exposing apparatus 1; development apparatuses 2*a*, 2*b*, 2*c* and 2*d*; a middle transfer belt unit 8; a fixing apparatus 12; cleaning apparatuses 4*a*, 4*b*, 4*c*, and 4*d*; and a charge removal apparatus (not shown). The middle transfer belt unit 8 has a middle transfer body 7; middle transfer apparatuses 6*a*, 6*b*, 6*c*, and 6*d*; and a transfer apparatus 11.

Note that image data that the image forming apparatus 100 can handle includes image data in accordance with four hues: black (K), cyan (C), magenta (M) and yellow (Y), in addition to image data in accordance with a unicolored image. Accordingly, four types of images in accordance with each color are formed by disposing four apparatuses each, such as the development apparatuses 2*a*, 2*b*, 2*c*, and 2*d*; the photosensitive drums 3*a*, 3*b*, 3*c*, and 3*d* as an image carrier; the cleaning apparatuses 4*a*, 4*b*, 4*c*, and 4*d*; the charging apparatuses 5*a*, 5*b*, 5*c*, and 5*d*; and the middle transfer apparatuses 6*a*, 6*b*, 6*c*, and 6*d*.

In this embodiment, suffix reference signs a, b, c, and d that are given to reference signs denoting members correspond to black (K), cyan (C), magenta (M), and yellow (Y), respectively.

That is, the image forming apparatus 100 is provided with a black image station including the development apparatus 2*a*, the image carrier 3*a*, the charging apparatus 5*a*, the cleaning apparatus 4*a*, and the middle transfer apparatus 6*a*; a cyan image station including the development apparatus 2*b*, the image carrier 3*b*, the charging apparatus 5*b*, the cleaning apparatus 4*b*, and the middle transfer apparatus 6*b*; a magenta image station including the development apparatus 2*c*, the image carrier 3*c*, the charging apparatus 5*c*, the cleaning apparatus 4*c* and the middle transfer apparatus 6*c*; and a yellow image station including the development apparatus 2*d*, the image carrier 3*d*, the charging apparatus 5*d*, the cleaning apparatus 4*d* and the middle transfer apparatus 6*d*.

In this embodiment, the image forming apparatus 100 is a tandem-type apparatus, and the image stations are arranged in a line along the moving direction of the surface of the middle transfer body 7 (direction indicated by an arrow B in FIG. 5). Note that these members shown in FIG. 5 will be described with the suffix reference signs (a, b, c, and d) omitted in the description below.

In the image stations, the photosensitive drum 3 as an image carrier is a drum-type photosensitive body. The charging apparatus 5 uniformly charges the surface of the photosensitive drum 3 at a prescribed electric potential, and is a charging unit including a contact-type charging roller herein. The exposing apparatus 1 forms an electrostatic latent image on the photosensitive drum 3, and is an exposing unit herein. The development apparatus 2 visualizes an electrostatic latent image formed on the photosensitive drum 3 using toner.

A visible image, i.e. a toner image, on the photosensitive drum 3 that is visualized by the development apparatus 2 is transferred once onto the middle transfer body 7. In this embodiment, the middle transfer body 7 is a belt-type middle transfer body and, specifically, is a middle transfer belt. The middle transfer apparatus 6 transfers a toner image formed on the photosensitive drum 3 once onto the middle transfer body 7, and is used as a middle transfer roller herein.

The transfer apparatus 11 transfers a toner image formed on the middle transfer body 7 onto a recording medium, and is used as a transfer roller herein. The fixing apparatus 12 fixes the image transferred on the recording medium onto the recording medium, and is used as a fixing unit herein.

The cleaning apparatus 4 removes residual toner remaining on the surface of the photosensitive drum 3 that was not transferred by the middle transfer apparatus 6, and is used as a cleaning unit herein. The aforementioned charge removal apparatus removes residual charge remaining on the surface of the photosensitive drum 3.

Also, the image forming apparatus 100 further includes a cleaning apparatus 9 for the middle transfer body. The cleaning apparatus 9 for the middle transfer body removes residual toner remaining on the surface of the middle transfer body 7 that was not transferred by the transfer apparatus 11, and is used as a transfer belt cleaning unit herein.

Note that the image forming apparatus 100 may not include the middle transfer body 7 and the transfer apparatus 11. In this case, the middle transfer apparatus 6 can be used as a transfer apparatus that transfers toner on the photosensitive drum 3 onto a recording medium.

In addition, the photosensitive body may be a belt-type body. The middle transfer body 7 may be a drum-type body. Other than a contact-charging-roller-type charging unit, for example, a brush-type charging unit, a non-contact-charging-type charging unit and the like can be used as the charging apparatus 5.

The photosensitive drums 3 are pressed by the corresponding middle transfer apparatus 6 via the middle transfer body 7. The surface of the photosensitive drums 3 moves in the prescribed direction (direction indicated by an arrow X in FIG. 5). Also, the surface of the middle transfer body 7 moves in the same direction as the shifting direction X of the surface of the photosensitive drum 3 (direction indicated by the arrow B in FIG. 5). Consequently, the photosensitive drums 3 are driven to rotate with the middle transfer body 7 at the same circumferential speed as the middle transfer body 7, and the middle transfer apparatuses 6 rotate so as to follow the middle transfer body 7.

The exposing apparatus 1 is used as a laser scanning unit (LSU) and includes a laser irradiation section 1*a* that irradiates a laser beam onto the photosensitive drums 3, respectively, and a plurality of reflecting mirrors 1*b* that guide the laser beam to the corresponding photosensitive drum 3. The exposing apparatus 1, while modulating laser beams in accordance with image data constituted from black, cyan, magenta and yellow hues, performs exposure by irradiating the surfaces of the photosensitive drums 3 that have been charged, respectively. By doing so, an electrostatic latent image is formed in accordance with the respective image data. Note that a writing head in which light emitting elements such as an electroluminescence (EL) element and a light emitting diode (LED) are arranged so as to form an array may be used as the exposing apparatus 1.

The development apparatuses 2 have the same configuration as the development apparatus shown in FIG. 1, and make an electrostatic latent image formed on the corresponding photosensitive drum 3 develop by using toner, that is, a black toner, a cyan toner, a magenta toner, and a yellow toner.

Black, cyan, magenta and yellow two-component developers are contained in the development tanks 33 of the development apparatuses 2 in accordance with the image forming in the image stations. The developer includes toner that is charged so as to be similarly polarized to a surface potential of the charged photosensitive drum 3. Note that both of the polarity of the surface potential of the charged photosensitive drum 3 and the charging polarity of the toner to be used are negative herein. The development apparatuses 2 mix and stir the two-component developer in the development tank 33, and by triboelectric charging being performed between toner and a magnetic carrier, each charged colored toner is adhered and adsorbed onto an electrostatic latent image on the surface of the photosensitive drum 3. Then, an each colored toner image is formed on the surface of the photosensitive drums 3. That is, the development apparatuses 2 use a two-component developer that contains toner and a magnetic carrier to form a toner image by reverse developing an electrostatic latent image with toner, the electrostatic latent image being formed on the surface of the photosensitive drum 3 by the exposing apparatus 1.

In this embodiment, the development apparatuses 2 are provided with toner hoppers 101*a*, 101*b*, 101*c*, and 101*d* as a toner containing tank; and toner conveying mechanisms 102*a*, 102*b*, 102*c* and 102*d*. Note that, these toner hoppers and toner conveying mechanisms shown in FIG. 5 will be described in the description below with suffix reference signs (a, b, c, d) omitted. The toner hoppers 101 are disposed above the corresponding development apparatus 2 in the vertical direction, and respectively store black, cyan, magenta and yellow toner that has not been used and that is powdery. The toner hoppers 101 supply toner that is contained therein to the toner supply opening 332 of the development tank 33 via the toner conveying mechanism 102. The specific configuration of the development apparatus 2 is as described above, so detailed description will be omitted.

In the image forming apparatus 100, the middle transfer belt unit 8 includes a transfer belt drive roller 71, a transfer belt idler roller 72 and a transfer belt tension roller 73, in addition to the aforementioned middle transfer body 7, middle transfer apparatuses 6 and transfer apparatus 11. The middle transfer belt unit 8 is disposed above the photosensitive drums 3, and revolvably and movably supports the middle transfer body 7 in the direction indicated by the arrow B, with the middle transfer body 7 spanning the transfer belt drive roller 71, the transfer belt idler roller 72 and the middle transfer apparatuses 6. Further, while the middle transfer body 7 is tensioned by the transfer belt tension roller 73, the middle transfer belt unit 8 presses the middle transfer apparatuses 6 against the photosensitive drums 3, and presses the transfer apparatus 11 against the transfer belt drive roller 71 via the middle transfer body 7.

Transferring a toner image from the photosensitive drum 3 to the middle transfer body 7 is performed by the middle transfer apparatuses 6 that are in contact with a side of the middle transfer body 7 opposite to the side with which the photosensitive drum 3 is in contact. The middle transfer apparatuses 6 give a transfer bias for transferring a toner image formed on the photosensitive drum 3, onto the middle transfer body 7. That is, a high voltage transfer bias is applied to the middle transfer apparatuses 6 in order to transfer a toner image. In this embodiment, a high voltage transfer bias has a positive polarity that is opposite to the toner charging polarity having a negative polarity.

The middle transfer apparatuses 6 cause their own electric field to affect toner on the surface of the photosensitive drums 3 via the middle transfer body 7, and toner on the surface of the photosensitive drums 3 is transferred by being attracted to the middle transfer body 7. Consequently, the image forming apparatus 100 can successively transfer and superimpose a toner image that is made to develop in accordance with the colors on the photosensitive drum 3 onto the middle transfer body 7.

In order to more stably form each nip area between a middle transfer roller 6 that is one example of the middle transfer apparatuses and the photosensitive drums 3, the middle transfer rollers 6 are preferably formed of a material having elastic properties. For example, the middle transfer roller can be made based on a metal (e.g., stainless steel) shaft whose diameter is 8 to 10 mm and can be a roller whose surface is covered with a electrically conductive material having elastic properties (e.g., materials such as EPDM or urethane foam). By using such a electrically conductive material having elastic properties, the middle transfer roller 6 can uniformly apply a high voltage to the middle transfer body 7. Note that, in the present embodiment, a transfer roller is used to transfer polarity, but also a brush and the like can be used.

The middle transfer body 7 is disposed so as to be in contact with the photosensitive drums 3. Each colored toner image formed on each of the photosensitive drums 3 is successively transferred so as to be superimposed on the surface of the middle transfer body 7, and accordingly, a colored toner image (i.e. multicolored toner image) is formed. In this embodiment, the middle transfer body 7 is a middle transfer belt that is formed so as to be loop shaped using a film that is approximately 100 to 150 μm thick.

Consequently, each colored toner image that has been transferred and superimposed on the middle transfer body 7 is transported to a nip area between the transfer belt drive roller 71 and the transfer apparatus 11, along with the middle transfer body 7 revolving and moving. Then, the each colored toner image is superimposed on a recording medium transported by a registration roller 14 in synchronization with the each colored toner image on the middle transfer body 7, and the each colored toner image is transferred onto the recording medium by the transfer apparatus 11. A high voltage transfer bias is applied to the transfer apparatus 11 to transfer the toner image. The transfer bias has a high voltage having a positive polarity, which is opposite the charging polarity of the toner that has a negative polarity.

The transfer apparatus 11, which can be a transfer roller, is supported so as to be movable in a direction approaching and separating from the transfer belt drive roller 71 via the middle transfer body 7, and is biased to the transfer belt drive roller 71. Accordingly, the middle transfer body 7 is nipped between a transfer roller 11 and the transfer belt drive roller 71; thus, a nip area is formed. In order to steadily obtain the nip area, either one of the transfer roller 11 or the transfer belt drive roller 71 can be made of a hard material such as metal, and the other can be a roller made of a soft material such as an elastic roller, that is, a roller made of elastic rubber, foamable resin, and the like.

While serving as a backup roller for the transfer roller 11, the transfer belt drive roller 71 is driven to rotate, with each nip area between the middle transfer rollers 6 and the photosensitive drums 3 being on a downstream side, and revolves and shifts the middle transfer body 7 by pulling in the direction indicated by the arrow B, resulting in each nip area being stably maintained.

The cleaning apparatus 4 removes and collects residual toner on the surface of the photosensitive drum 3 after a development and an image transfer process.

Also, the cleaning apparatus 9 for the middle transfer body includes a cleaning blade that scrubs the surface of the middle transfer body 7. Toner adhered to the middle transfer body 7 by the middle transfer body 7 contacting the photosensitive drum 3, and residual toner on the middle transfer body 7 that was not transferred when transferring an toner image from the middle transfer body 7 to the recording medium cause a mixture of colored toners to be generated in a next process.

Thus, the cleaning apparatus 9 for the middle transfer body removes and collects residual toner on the surface of the middle transfer body 7 and prevents an image to be formed next from being fogged, colors thereof from being mixed and the like. The middle transfer body 7 with which the cleaning blade is in contact is supported from the side opposite the blade-contact side, by the transfer belt idler roller 72.

The fixing apparatus 12 is equipped with a hot roller 81 and a pressure roller 82. The hot roller 81 and the pressure roller 82 rotate, with a recording medium being nipped. Accordingly, each colored toner on a recording medium is heated and melted so as to be mixed, and each colored toner image is fixed on the recording medium as a multicolored image. The hot roller 81 is controlled so as to have a prescribed fixing temperature by a controller (not shown), based on a signal from a thermal sensing apparatus (not shown). The hot roller 81 performs thermocompression on the recording medium together with the pressure roller 82. By doing so, each colored toner image transferred on the recording medium is melted, mixed, and welded with pressure, thus being thermally compressed onto the recording medium.

The image forming apparatus 100 further includes a paper feed tray 10, a manual feed tray 20, a recording medium transport path S, and a discharge tray 15.

The paper feed tray 10 and the manual feed tray 20 store a recording medium to be used when forming an image and are disposed below the exposing apparatus 1 herein. In addition, the discharge tray 15 is disposed above the middle transfer belt unit 8, and herein used for placing a recording medium to be discharged.

The recording medium transport path S transports a recording medium from the paper feed tray 10 or the manual feed tray 20, via the middle transfer belt unit 8 and the fixing apparatus 12, to the discharge tray 15. Near the recording medium transport path S from the paper feed tray 10 and the manual feed tray 20 to the discharge tray 15, pickup rollers 16*a* and 16*b*, the registration roller 14, the fixing apparatus 12, and transport rollers 25*a* to 25*h* that transport a recording medium are arranged. Note that the transport roller 25*c* will be referred to as a discharge roller in the following.

The transport roller 25 is a small-sized roller that facilitates and assists a recording medium to be transported, and a plurality of transport rollers 25 are disposed along the recording medium transport path S. The pickup rollers 16*a* and 16*b* are bring-in rollers that supply a recording medium from the trays 10 and 20, one by one, to the recording medium transport path S.

The registration roller 14 temporarily keeps a recording medium to be transported. The registration roller 14 has a function to transport a recording medium with the proper timing so that a toner image on the middle transfer body 7 can be transferred well and superimposed on a recording medium, in accordance with the middle transfer body 7 revolving. That is, the registration roller 14 transports a recording medium so that the end of an image forming area on the middle transfer body 7 is matched with the end of an image forming area of a recording medium, based on a detection signal output by a pre-registration detection switch (not shown).

A recording medium on which a toner image has been fixed is transported by the transport roller 25*b* and the discharge roller 25*c*, and discharged on the discharge tray 15 in a manner such that the toner image faces downward. Note that a monochrome image can be formed using only the black image station and can be transferred on the middle transfer body 7. The monochrome image can also be transferred from the middle transfer body 7 onto a recording medium, and fixed on the recording medium, and the recording medium on which the monochrome image has been formed can be discharged on the discharge tray 15, as well as a colored image.

Further, when performing an image forming (hereinafter, printing) process, not only on a front side of a recording medium, but also on both sides, after an image formed on the front side of the recording medium is fixed by the fixing apparatus 12, while the recording medium is transported by the discharge roller 25*c*, the discharge roller 25*c* is stopped and reversed so that the recording medium passes through a reverse path 51. Then, after the recording medium is turned over so that the front and back sides are reversed, the recording medium is led to the registration roller 14. As well as printing the front side of the recording medium, an image is recorded and fixed on the back side of the recording medium, and the recording medium can be discharged on the discharge tray 15.

Meanwhile, as for the photosensitive drum 3 that has transferred a toner image onto a recording medium, residual toner on the surface of the photosensitive drum 3 is removed by the cleaning apparatus 4, and a residual charge on the surface of the photosensitive drum 3 is removed by the charge removal apparatus (not shown). Then, the photosensitive drum 3 is again charged by the charging apparatus 5.

Next, a recording medium transport operation through the recording medium transport path S will be described. As described above, the paper feed tray 10 for storing recording media in advance and the manual feed tray 20 that is mainly used when performing a small amount of printing and the like are disposed in the image forming apparatus 100. The pickup rollers 16*a* and 16*b* are respectively disposed to these trays, and these pickup rollers 16 supply a recording medium, one by one, to the recording medium transport path S.

In the case of printing one side, a recording medium transported from the paper feed tray 10 is transported by the transport roller 25*a* that is disposed on the recording medium transport path S, to the registration roller 14. Then, it is transported by the registration roller 14 to a transfer section at a correct time so that the end of the recording medium is matched with the end of a toner image superimposed on the middle transfer body 7. The transfer section transfers a toner image on a recording medium, and the fixing apparatus 12 fixes the toner image on the recording medium. Subsequently, the recording medium is transported by the transport roller 25*b* and discharged on the discharge tray 15 by the discharge roller 25*c*.

Further, a recording medium transported from the manual feed tray 20 is transported by the plurality of transport rollers 25*f*, 25*e*, and 25*d* to the registration roller 14. The recording medium follows the same processes as that of a recording medium supplied from the paper feed tray 10 takes, and is discharged on the discharge tray 15.

In the case of printing both sides, after one side of a recording medium has been printed as described above, the recording medium passes through the fixing unit 12. Then, the trailing edge is clamped by the discharge roller 25*c*. Next, the recording medium is led to the transport rollers 25*g* and 25*h* by the discharge roller 25*c* rotating in a reverse direction. After the recording medium is transported by the registration roller 14 and the back side thereof is printed, it is discharged on the discharge tray 15.

Since the image forming apparatus 100 that has been described above includes the development apparatus 2 shown in FIG. 1, a toner aggregate that may occur in the development apparatus 2 can be effectively prevented. Thus, image failure such as image irregularity can be suppressed from occurring for a long time.

Note that, although a tandem-type colored image forming apparatus having a plurality of image carriers is used as the development apparatus 2, the technology may be applied to a monochrome image forming apparatus or a colored image forming apparatus that has a single image carrier.

The technology may be embodied in various other forms without departing from the spirit or essential characteristics thereof. The embodiments disclosed in this application are to be considered in all respects as illustrative and not limiting. The scope of the technology is indicated by the appended claims rather than by the foregoing description, and all modifications or changes that come within the meaning and range of equivalency of the claims are intended to be embraced therein.

What is claimed is:

1. A development apparatus comprising:

a developer carrier that transports a two-component developer; and a scraper that detaches the two-component developer transported by the developer carrier from a surface of the developer carrier, wherein a front end of the scraper is formed so as not to have an edge formed between two surfaces that form an angle of less than 90 degrees, and wherein the scraper is disposed so that a gap of 0.8 to 1.5 mm is formed between the scraper and a surface of the developer carrier.

2. The development apparatus according to claim 1, wherein the front end of the scraper is formed so as to be composed of flat surfaces that form obtuse angles with respect to each other.

3. The development apparatus according to claim 1, wherein a top face of the front end of the scraper is formed so as to have a radius of curvature that increases with distance from the developer carrier.

4. The development apparatus according to claim 1, wherein the scraper is disposed so as to be inclined by 30 to 60 degrees, inclusive, with respect to a horizontal direction.

5. The development apparatus according to claim 1, further comprising a scraper pedestal having rigidity, wherein the scraper is fixed on the scraper pedestal.

6. The development apparatus according to claim 5, wherein the scraper is integrally formed with the scraper pedestal.

7. The development apparatus according to claim 1, wherein the scraper is made of a resin that includes a electrically conductive carbon black.

8. The development apparatus according to claim 1, wherein the scraper is made of a resin that includes a silica microparticle or a glass fiber.

9. An image forming apparatus comprising the development apparatus according to claim 1.

10. A development apparatus comprising:

a developer carrier that transports a two-component developer; and a scraper that detaches the two-component developer transported by the developer carrier from a surface of the developer carrier, wherein a front end of the scraper is formed so as not to have an edge formed between two surfaces that form an angle of less than 90 degrees, and wherein the scraper is made of a resin that includes electrically conductive carbon black.

11. A development apparatus comprising:

a developer carrier that transports a two-component developer; and a scraper that detaches the two-component developer transported by the developer carrier from a surface of the developer carrier, wherein a front end of the scraper is formed so as not to have an edge formed between two surfaces that form an angle of less than 90 degrees, and wherein the scraper is made of a resin that includes a silica microparticle or a glass fiber.

* * * * *